US008010002B2

(12) United States Patent
Nishikawa et al.

(10) Patent No.: US 8,010,002 B2
(45) Date of Patent: Aug. 30, 2011

(54) IMAGE FORMING APPARATUS

(75) Inventors: Eiji Nishikawa, Hino (JP); Satoshi Ogata, Hachioji (JP)

(73) Assignee: Konica Minolta Business Technologies, Inc., Chiyoda-ku, Tokyo (JP)

( * ) Notice: Subject to any disclaimer, the term of this patent is extended or adjusted under 35 U.S.C. 154(b) by 353 days.

(21) Appl. No.: 12/401,685

(22) Filed: Mar. 11, 2009

(65) Prior Publication Data

US 2009/0238586 A1 Sep. 24, 2009

(30) Foreign Application Priority Data

Mar. 21, 2008 (JP) ..... 2008-073131

(51) Int. Cl.
*G03G 15/00* (2006.01)

(52) U.S. Cl. ..... 399/49
(58) Field of Classification Search ..... 399/38–40, 399/43, 46, 49
See application file for complete search history.

(56) References Cited

U.S. PATENT DOCUMENTS 7,113,712 B2 * 9/2006 Gomi ..... 399/48
7,149,445 B2 * 12/2006 Bares ..... 399/49
7,324,769 B2 * 1/2008 Yamaoka ..... 399/49

FOREIGN PATENT DOCUMENTS

JP 10-213940 A 8/1998

* cited by examiner

*Primary Examiner* — Hoan Tran
(74) *Attorney, Agent, or Firm* — Buchanan Ingersoll & Rooney PC

(57) ABSTRACT

An image forming apparatus includes a control section which controls a forming section and a detection section to form an image patterns at a non-image area between image areas on an image carrier, to detect the image patterns as required, and to execute various types of compensation operations for correcting image forming conditions, and, when a timing of executing a first compensation operation coincides with a timing of executing a second compensation operation and the image pattern for the first compensation operation and the image pattern for the second compensation operation have a relationship such that the positions of forming the image patterns on the image carrier do not overlap each other, controls the image forming section to form both image patterns in the same non-image area.

11 Claims, 10 Drawing Sheets

IMAGE FORMING APPARATUS

RELATED APPLICATION

The present application is based on Japanese Patent Application No. 2008-073131 filed with Japanese Patent Office on Mar. 21, 2008, the entire content of which is hereby incorporated by reference.

BACKGROUND OF THE INVENTION

1. Field of the Invention

The present invention relates to image forming apparatuses that form images on sheets from printers, facsimile machines, etc.

2. Description of the Related Art

In copying machines, printers, facsimiles, etc., very often the electro-photographic method is used in which images are formed on sheets using toners. Further, even color image forming apparatuses that form color images using toners of multiple colors are large in number, and recently, considering high productivity, tandem type color image forming apparatuses have appeared in which the photoreceptor, writing section, and developing section, etc., are provided for each color, and toner images of different colors are superimposed on one another in an intermediate image transfer member.

However, there is a demand from the users for outputting on sheets high quality images without any changes in time, and in said image forming apparatuses, compensation operations are made at regular intervals of time in order to stabilize the image quality. The compensation operations executed at regular intervals of time are, for example, the position shift compensation operation that corrects the writing timing in the writing sections so that the toner images of each of the colors of yellow (Y), magenta (M), cyan (C), and black (K) are superimposed on each other in the intermediate image transfer member without any shifts, or the operations of correcting the density or gray scale of the images, etc.

In order to execute compensation operations such as the position shift compensation operation or the image density compensation operation, etc., it is necessary to form image patterns for compensation on the photoreceptor or on the intermediate image transfer member, and to read out that image pattern using a sensor. However, stopping the print job that is currently being executed by the image forming apparatus in order to form the image pattern is not desirable from the point of view of productivity. Therefore, various types of technologies have been proposed for executing the compensation operations without stopping the print jobs.

The technology disclosed in Japanese Unexamined Patent Application Publication No. H10-213940 is a technology according to which, image patterns for color shift compensation are formed between the sheets in which images are formed on the image transfer belt (the non-image area), these image patterns are detected by sensors, and the phase of the polygon in the writing section is controlled. According to this technology, since there is no stopping of the print jobs executed in the image forming apparatus, it is possible to carry out color shift compensation operations while preventing a reduction in the productivity.

The compensation operations for stabilizing the image quality as described above are of many types, such as, position shift compensation operation, image density compensation operation, etc. The timing of executing these compensation operations is determined based on the number of times of image forming operations in the image forming apparatus, and it is possible that the timing of execution of different types of compensations coincide with each other.

In that case, it is possible to think of forming the image patterns for each of the different compensations in the non-image area as in the technology disclosed in Japanese Unexamined Patent Application Publication No. H10-213940, and also, for the image patterns for each of the different compensations in different non-image areas. However, if this is done, until the image pattern formed in the rear non-image area is detected by the sensor, it is not possible to execute the compensation operations based on that image pattern, and even though it has become possible to prevent a reduction in productivity in the image forming apparatus, the compensation operations for images gets delayed and it is possible that the image quality decreases.

In view of this, the purpose of the present invention is to provide an image forming apparatus in which the correction operations for stabilizing the image are executed without delay and also to prevent a reduction in productivity.

SUMMARY OF THE INVENTION

One aspect of the present invention is an image forming apparatus comprising: an image carrier; an image forming section which forms image patterns for a compensation operation on the image carrier; a detection section which detects the image patterns formed on the image carrier; and a control section which controls at least the image forming section and the detection section, wherein the control section controls the image forming section and the detection section to form the image patterns at a non-image area between image areas on the image carrier, to detect the image patterns as required, and to execute various types of compensation operations for correcting the image forming conditions, and, when a timing of executing a first compensation operation coincides with a timing of executing a second compensation operation and the image pattern for the first compensation operation and the image pattern for the second compensation operation have a relationship such that the positions of forming the image patterns on the image carrier do not overlap each other, controls the image forming section to form both image patterns in the same non-image area.

DESCRIPTION OF THE PREFERRED EMBODIMENTS

[Outline of an Image Forming Apparatus]

Figure 1:
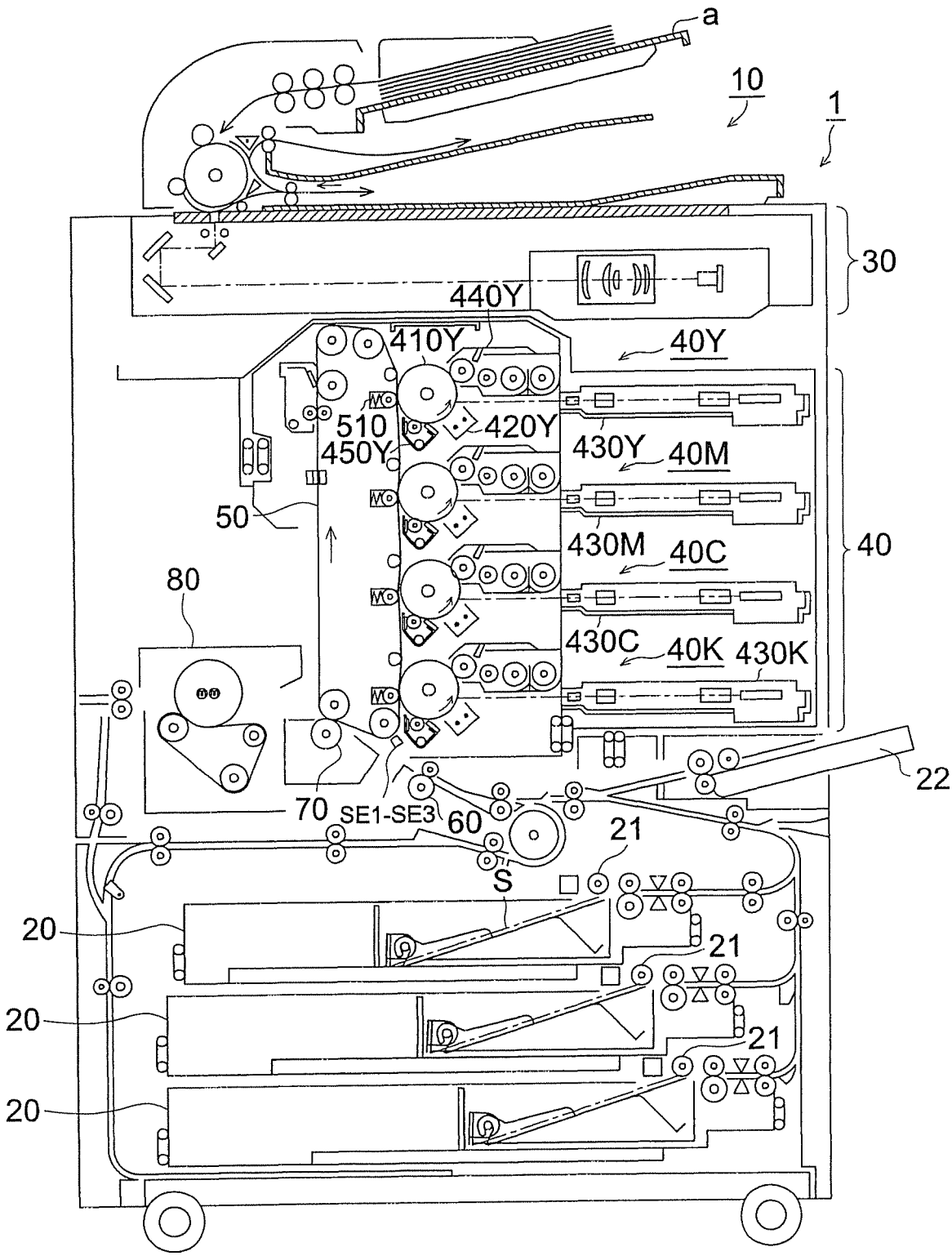
FIG. 1 is a center cross-sectional view diagram showing the internal configuration of an image forming apparatus.

FIG. 1 is a center cross-sectional view diagram showing the internal configuration of an image forming apparatus 1 according to the present invention. The image forming apparatus 1 is a tandem type color image forming apparatus having an intermediate image transfer belt 50. The original document planed on the document feeding table 'a' of the double-sided automatic document feeder 10 is conveyed towards the image reading section 30 by various types of rollers.

A plurality of sheet storage sections 20 are provided in the bottom part of the image forming apparatus 1. Further, the intermediate image transfer belt 50 is provided above the sheet storage sections 20, and the image read-out section 30 is provided in the top part of the main unit of the apparatus.

The sheet storage sections 20 can be drawn out from the front of the apparatus (towards the viewer away from the sheet surface in FIG. 1). The sheets S such as white paper, etc. are stored in a plurality of sheet storage sections 20 separating them according to their sizes. The sheets S stored in the sheet storage sections 20 are fed out one sheet at a time by the sheet feeding rollers 21. In addition, special sheets such as OHP film sheets, etc., are set in the hand feeding section 22.

Above the sheet storage sections 20 are installed four sets of image forming engines 40Y, 40M, 40C, and 40K for forming toner images of the different colors of Y, M, C, and K. The image forming engines 40Y, 40M, 40C, and 40K are arranged in that order from top to bottom in a straight line, and each of them have the same configuration. Explaining taking the example of the image forming engine 40Y for the yellow color, the image forming engine 40Y has a photoreceptor 410Y that rotates in the counterclockwise direction, a scorotron charging section 420Y, a light exposure section (writing section) 430Y, a developing section 440Y, and a cleaning section 450Y (in the present invention, the photoreceptor, scorotron charging section, light exposure section, and developing section for each color constitute an "image forming section 40"). The cleaning section 450Y is placed so as to include the region opposite the bottom-most part of the photoreceptor 410Y.

Figure 2:
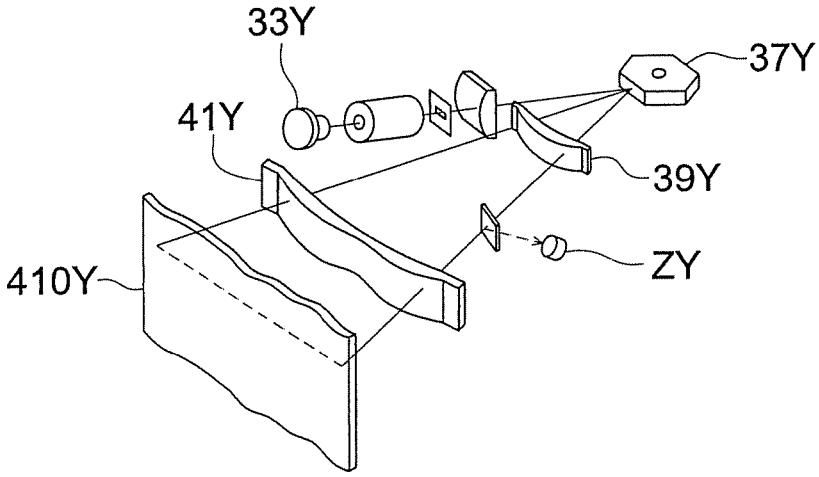
FIG. 2 is a perspective view diagram showing the internal structure of the exposure section.

FIG. 2 is a perspective view diagram showing the internal structure of the light exposure section 430Y.

The light exposure sections 430Y, 430M, 430C, and 430K are installed for each color in the image forming apparatus 1, and each of these light exposure sections have the same internal structure as that shown in FIG. 2. Here, the light exposure section 430Y for the yellow color is explained as a typical light exposure section.

33Y is a laser light source that emits laser light (light beam) modulated based on the image signal for the yellow color. The laser light emitted from the laser light source 33Y is reflected by the mirror surface in the polygon mirror 37Y, passes through the fθ lens 39Y and the cylindrical lens 41Y, and exposes the photoreceptor 410Y. Due to the exposure by this laser light, an electrostatic latent image is formed on the photosensitive surface of the photoreceptor 410Y. ZY is an index sensor. The index sensor ZY detects the beginning of scanning in the main scanning direction of the laser light, and outputs the index signal which is the horizontal synchronization signal.

The explanation of the image forming apparatus 1 is continued returning to FIG. 1. The primary transfer electrode 510 is provided at a position opposite the photoreceptor 410Y with the endless shaped intermediate image transfer belt 50 positioned at the center of the main unit of the apparatus between them.

The optical sensor SE1 detects the image pattern for compensation formed on the intermediate image transfer belt 50, and based on the result of this detection, the density compensation or color position shift compensation of the image are carried out.

Next, the method of forming color images in the image forming apparatus 1 is explained below.

The photoreceptor 410Y is driven in a rotary manner by the drum driving motor (not shown in the figure), and is charged negatively (to −800V, for example) by the discharge from the scorotron charging section 420Y. Next, an electrostatic latent image is formed on the photoreceptor 410Y by optical writing in accordance with the image information done by the light exposure section 430Y. At the time that the so formed electrostatic latent image passes through the developing section 440Y, the toner inside the developing section charged to a negative polarity gets adhered to the part of the electrostatic latent image due to the application of negative polarity development bias voltage, and a toner image is formed on the photoreceptor 410Y. The toner image so formed is transferred to the intermediate image transfer belt 50 that is in pressure contact with the photoreceptor 410Y. After transferring, any toner remaining on the photoreceptor 410Y is cleaned by the cleaning section 450Y.

The toner images formed by each of the image forming engines 40Y, 40M, 40C, and 40K are transferred on to the intermediate image transfer belt 50 in a superimposing manner, and a color image is formed on the intermediate image transfer belt 50.

The sheets S are fed out one sheet at a time from a sheet storage section 20, and are conveyed to the position of the register roller 60 that functions as a registered conveying section. A sheet S pushes against the register roller 60 and stops temporarily, and any skew in the sheet S is corrected. The sheet S is fed out from the register roller 60 at a timing that matches the position of the toner image on the intermediate image transfer belt 50.

A sheet S fed out from the register roller 60 is guided by guide plates, and is sent to the transfer nipping position formed by the intermediate image transfer belt 50 and the transfer section 70. The transfer section 70 formed by rollers presses the sheet S towards the intermediate transfer belt 50. By applying a bias voltage opposite in polarity to that of the toner (for example, +500V) to the transfer section 70, due to the action of electrostatic force, the toner image on the intermediate image transfer belt 50 is transferred onto the sheet S. The sheet S is discharged by a separating unit (not shown in the figure) made of discharging needles and is separated from the intermediate image transfer belt 50, and it is conveyed to the fixing unit 80 configured from heating rollers, pressure rollers, fixing belt, etc. As a result, the toner image is fixed onto the sheet S, and the image formed sheet S is discharged from the apparatus.

Further, although the image forming apparatus 1 in the present preferred embodiment is one that forms color images on sheets using the electro-photographic method, the image forming apparatuses according to the present invention shall not be restricted to the present preferred embodiment, and it is also possible that it is an image forming apparatus of the electro-photographic method that forms monochrome images.

Figure 3:
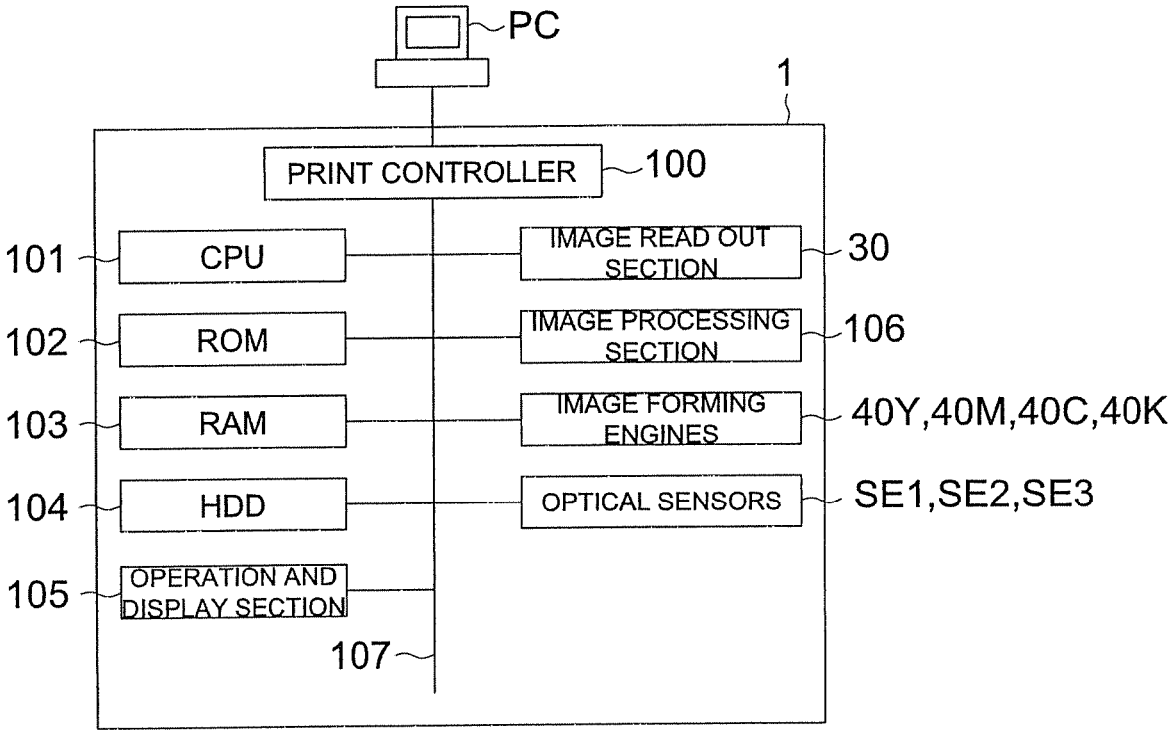
FIG. 3 is a block diagram of the control system of an image forming apparatus.

Block diagram of control system in the image forming apparatus:

FIG. 3 is a block diagram of the control system of an image forming apparatus 1, and only a typical one has been shown here. The CPU (Central Processing Unit) 101 is connected via a system bus 107 with a ROM (Read Only Memory) 102, a RAM (Random Access Memory) 103, etc. The CPU 101 reads out the different types of programs stored in the ROM 102 and expands them in the RAM 103, and controls the operations of different sections including the detection section of the image forming section. Further, the CPU 101 executes various types of processes according to the programs expanded in the RAM 103, and not only stores the results of those processes in the RAM 103 but also displays them in the operation and display section 105. Further, the processing results stored in the RAM 103 are stored in prescribed storage destinations. Further, in the present preferred embodiment, the CPU constitutes a control section by operating in collaboration with the ROM 102 and the RAM 103. The printer controller 100 is connected via a network with a PC which is a terminal, and receives print jobs transmitted by the PC. In addition, the operation of the image forming apparatus 1 is being monitored, and if there is a request from the PC, information (such as information on the residual quantity of consumable items, etc.) regarding the image forming apparatus 1 is transmitted to the PC.

The ROM 102 stores programs and data in advance, etc., and is typically constituted by semiconductor memories.

The RAM 103 constitutes a work area that temporarily stores the data, etc., processed by the different programs executed by the CPU 101.

The HDD 104 has the function of storing the image data of the original document image obtained by reading out in the image read out section 30, or of storing the image data, etc., that has already been output. For example, a hard disk drive, etc., is used as the HDD 104.

The operation and display section 105 makes it possible to make various types of settings. The operation and display section 105, for example, has the form of a touch panel, and by inputting through the operation and display section 105, the user can set various conditions related to color printing or monochrome printing. In addition, various types of information, such as information on network settings, etc., are displayed in the operation and display section 105.

The image read out section 30 optically reads out the image of the original document and converts it into electrical signals. When reading out original color documents, image data having luminance information of 10 bits for each of the colors RGB for each pixel is generated.

The image data generated by the image read out section 30, or the image data transmitted from a PC connected to the image forming apparatus 1 is subjected to image processing by the image processing section 106. When carrying out color printing in the image forming apparatus 1, the R (Red), G (Green), and B (Blue) image data generated by the image read out section 30 is input to the color conversion LUT in the image processing section 106, and the image processing section 106 carries out image conversion of the RGB data into Y (Yellow), X (Magenta), C (Cyan), and K (Black) image data. Further, the image processing section 106 carries out compensation of gray scale reproduction characteristics, screen processing of node point by referring to the density compensation LUT, or carries out edge processing for emphasizing thin lines, on the color converted image data.

The image forming engines 40Y, 40M, 40C, and 40K receive the image data after image processing by the image processing section 106, and form images on a sheet S. In addition, the image patterns for compensation are detected by the optical sensors SE1, SE2, and SE3 that function as a detection section, and based on the result of that detection, the operations of the image forming engines 40Y, 40M, 40C, and 40K are controlled by the CPU 101, etc.

The image forming apparatus 1, executes the compensation operation at regular intervals of time in order to stabilize the image quality. The compensation operations executed in the image forming apparatus 1 can be, for example, the position shift compensation operation, maximum density compensation operation, or gray scale compensation operation. In addition, although not as a compensation operation by detecting image patterns, but as an operation of compensating the image forming conditions, there is also the forcible discharge of toner from the development section 440Y, etc. These compensation operations are explained in the following.

[Position Shift Compensation Operation]

Figure 4:
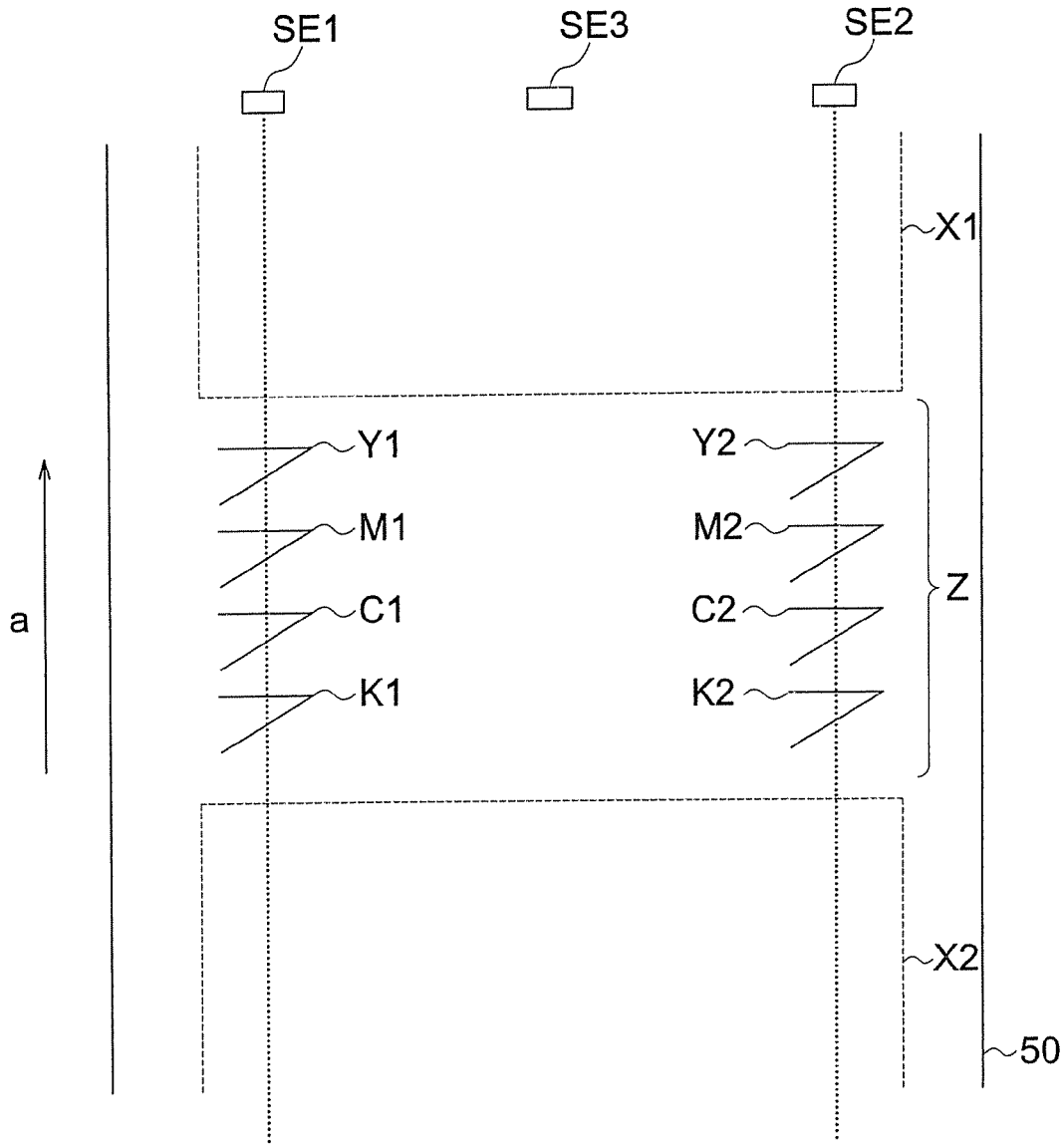
FIG. 4 is an explanatory diagram in which image patterns for position shift compensation are formed in the non-image area on the intermediate image transfer belt.
Figure 5:
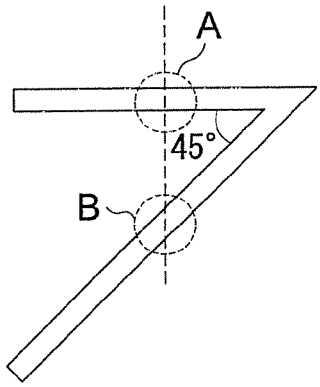
FIG. 5 is an enlarged view diagram of an image pattern for position shift compensation.
Figure 6:
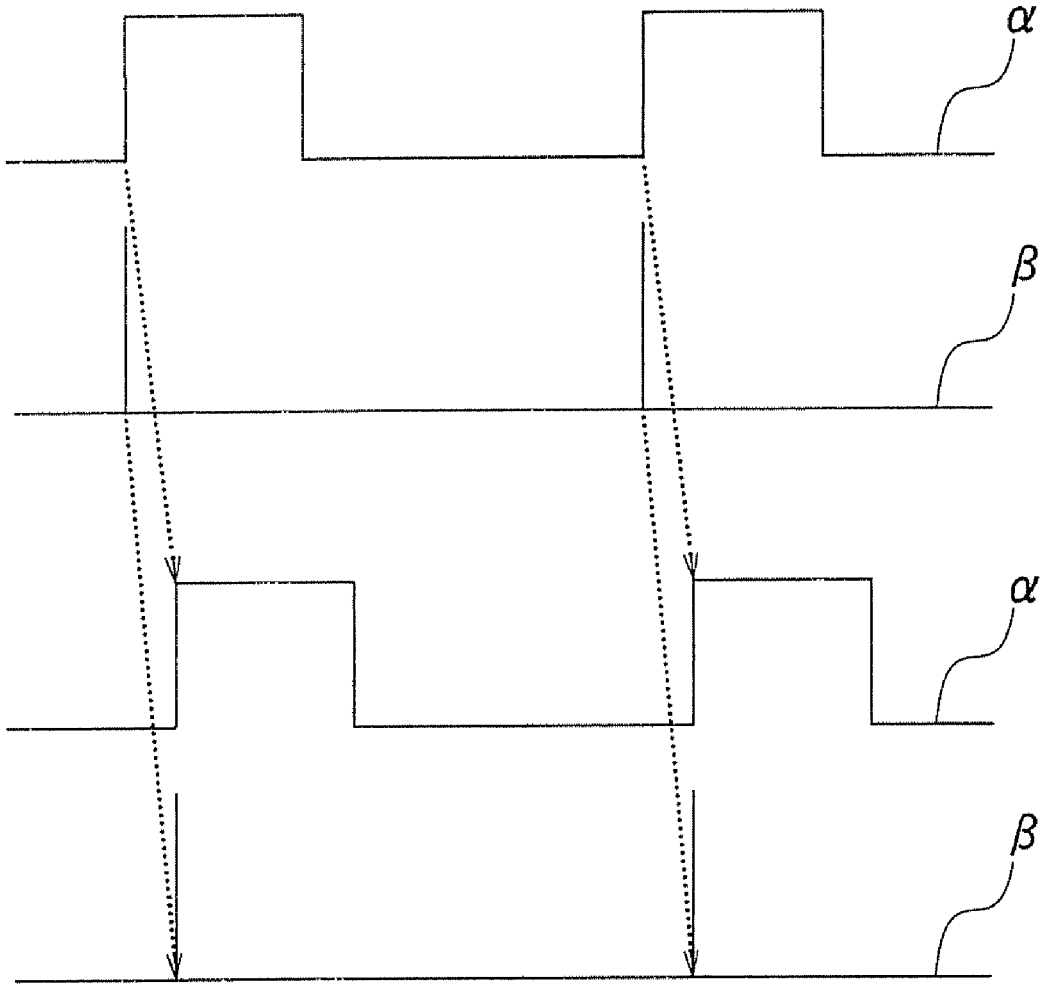
FIG. 6 is an explanatory diagram for adjusting the phase of the drive clock and the phase of the index signal in the polygon.

Firstly, using FIG. 4 to FIG. 6, the position shift compensation operation is explained here. In order to form high quality color images on the sheets S, it is necessary to superimpose on the intermediate image transfer belt 50 the toner images of different colors without any shift in their positions. Therefore, in order to compensate for the position shift of the toner images of different colors that occurs over the passage of time, the scanning positions of the photoreceptors by the different light exposure sections 430Y, 430M, 430C, and 430K are corrected periodically.

In order to execute the position shift compensation operation, the image patterns for position shift compensation Y1, Y2, M1, M2, C1, C2, K1, and K2 with a sideways V-letter shape are formed on the intermediate image transfer belt 50 as is shown in FIG. 4. Further, the image patterns for position shift compensation are formed in the non-image area Z between the image areas X1 and X2 in the intermediate image transfer belt 50. Because the image patterns are formed in the non-image area Z, since it is not necessary to stop the print job that is being executed by the image forming apparatus 1, it is possible to prevent a reduction in the productivity. The image area described here is an area of a sheet size corresponding to a position of the sheet to which images are to be transferred on the image carrier such as the intermediate image transfer belt or the photoreceptor drum, and the non-image area described here is an area between the image area and the following image area.

As is shown in FIG. 4, one each of the image patterns of the sideways V-letter shape are formed for each of the colors at the left side and right side of the intermediate image transfer belt 50, and a total of 8 image patterns are formed in one non-image area including the left and right parts of the area. Further, the neighboring image patterns at the left and right are of the same color, and they are formed in the sequence Y, M, C, and K.

The image patterns on the left side are detected by the optical sensor SE1, and the image patterns on the right side are detected by the optical sensor SE2. As is shown in FIG. 5, the angle of the sideways V-letter shape is 45 degrees, and due to the movement of the intermediate image transfer belt 50 (in the direction as in FIG. 4), the region A and the region B of each pattern are detected. Based on the difference in detection times of region A and region B for each image pattern, the position shift of each color is calculated, and the scanning positions of the photoreceptors by the different light exposure sections 430Y, 430M, 430C, and 430K are adjusted by the CPU 101, etc.

It has become possible to adjust to less than one scanning line by shifting the scanning position by small quantities, by carrying out the adjustment of the scanning positions not only by adjusting in units of one index signal unit, that is, in other words, in units of one scanning line, but also by adjusting the phase between the different index signals. In other words, position shifts in units of one scanning line are compensated for by adjusting the image area signal, and position shifts of less than one scanning line are compensated for by adjusting the phase of the drive clock in the polygon inside the light exposure section.

In the phase control of the drive clock $\alpha$ in the polygon as is shown in FIG. 6, the polygon motor is controlled based on the position shift information that has been calculated, the phase of the index signal $\beta$ is adjusted (as indicated by the dotted line arrows), and position shifts of less than one line are corrected.

[Maximum Density Compensation Operation]

Figure 7:
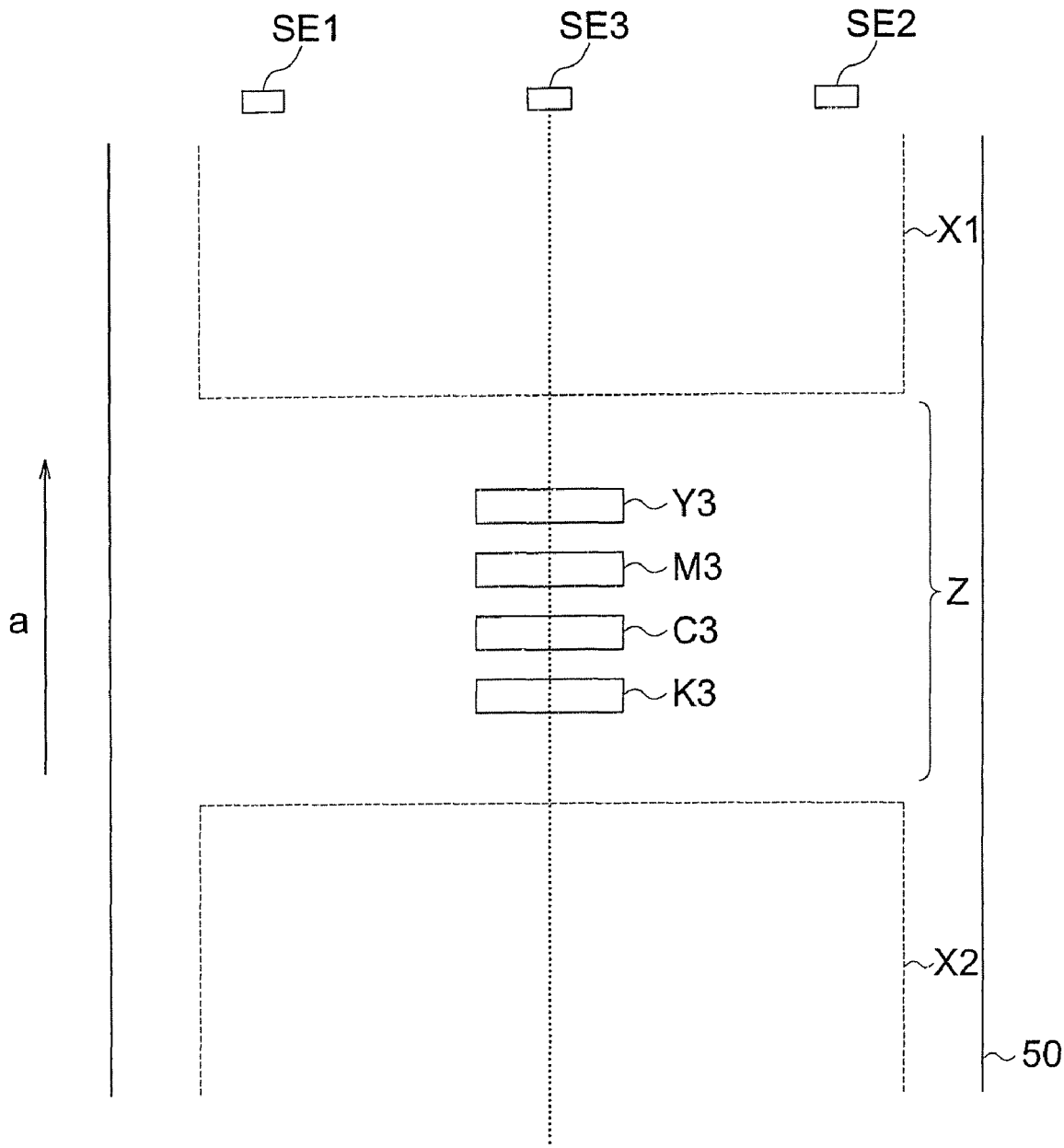
FIG. 7 is an explanatory diagram for forming the image pattern for the maximum density compensation in the non-image area of the intermediate image transfer belt.

Next the maximum density compensation operation is explained here using FIG. 7. When executing the maximum density compensation operation, as is shown in FIG. 7, image patterns Y3, M3, C3, and K3 for maximum density compensation for each color (4 colors) are formed on the intermediate image transfer belt 50, and these image patterns are detected by the optical sensor SE3 positioned at the center of the intermediate image transfer belt 50.

Similar to the image patterns for position shift compensation described above, the image patterns Y3, M3, C3, and K3 for maximum density compensation are formed on the intermediate image transfer belt 50 in the non-image area Z between the image areas X1 and X2. Because the image patterns are formed in the non-image area Z, since it is not necessary to stop the print job that is being executed by the image forming apparatus 1, it is possible to prevent a reduction in the productivity.

When the image patterns Y3, M3, C3, and K3 for maximum density compensation are detected by the optical sensor SE3, based on the result of that detection, the contrast potential Vcont which is the difference between the development bias potential and the bright part potential is controlled by the CPU 101, etc., and the desired development condition is reached. Because of this, the maximum density of each color becomes the appropriate value.

[Gray Scale Compensation Operation]

Figure 8:
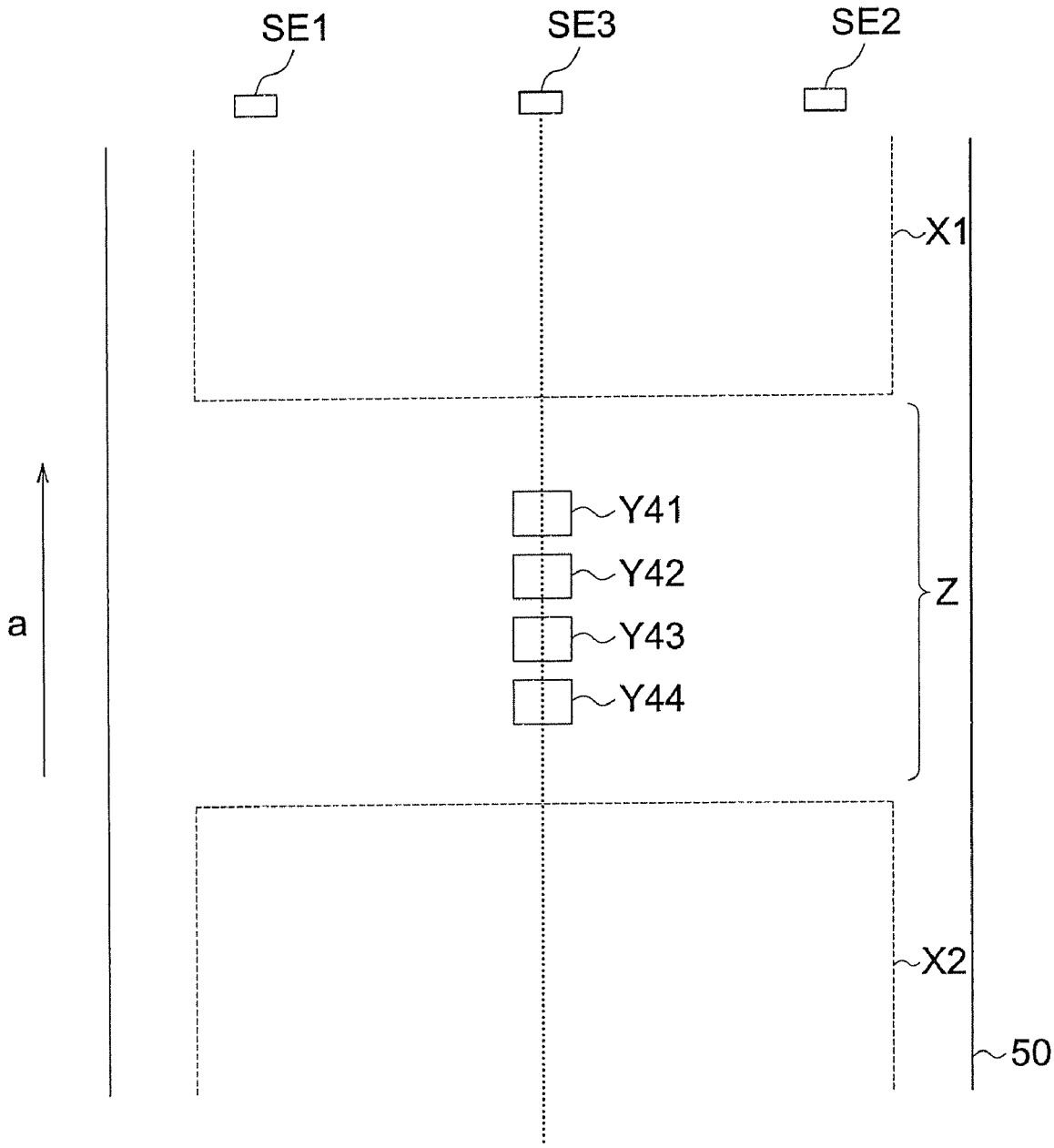
FIG. 8 is an explanatory diagram for forming the image pattern for gray scale compensation in the non-image area of the intermediate image transfer belt.

Next, the gray scale compensation operation is explained here using FIG. 8. When executing gray scale compensation operation, as is shown in FIG. 8, a plurality of image patterns with different densities of each color are formed on the intermediate image transfer belt 50, and the gray scale is compensated based on the differences in their densities. Although in FIG. 8, image patterns Y41, Y42, Y43, and Y44 with different densities have been formed in the yellow color, they are also formed similarly for the colors magenta, cyan, and black. The image patterns for gray scale compensation are detected by the optical sensor SE3 positioned at the center of the intermediate image transfer belt 50. In the present preferred embodiment, the image pattern for gray scale compensation of one color is formed in one non-image area Z, and the image patterns for the four colors are formed using several different non-image areas.

Similar to the image patterns for position shift compensation described above, the image patterns Y41, Y42, Y43, and Y44 for gray scale compensation are formed on the intermediate image transfer belt 50 in the non-image area Z between the image areas X1 and X2. Because the image patterns are formed in the non-image area Z, since it is not necessary to stop the print job that is being executed by the image forming apparatus 1, it is possible to prevent a reduction in the productivity.

When the image patterns Y41, Y42, Y43, and Y44 for gray scale compensation are detected by the optical sensor SE3, based on the result of that detection, the look-up table related to gray scale compensation for the yellow color is corrected, and the gray scale linearity is stabilized.

[Forced Toner Discharge]

Figure 9:
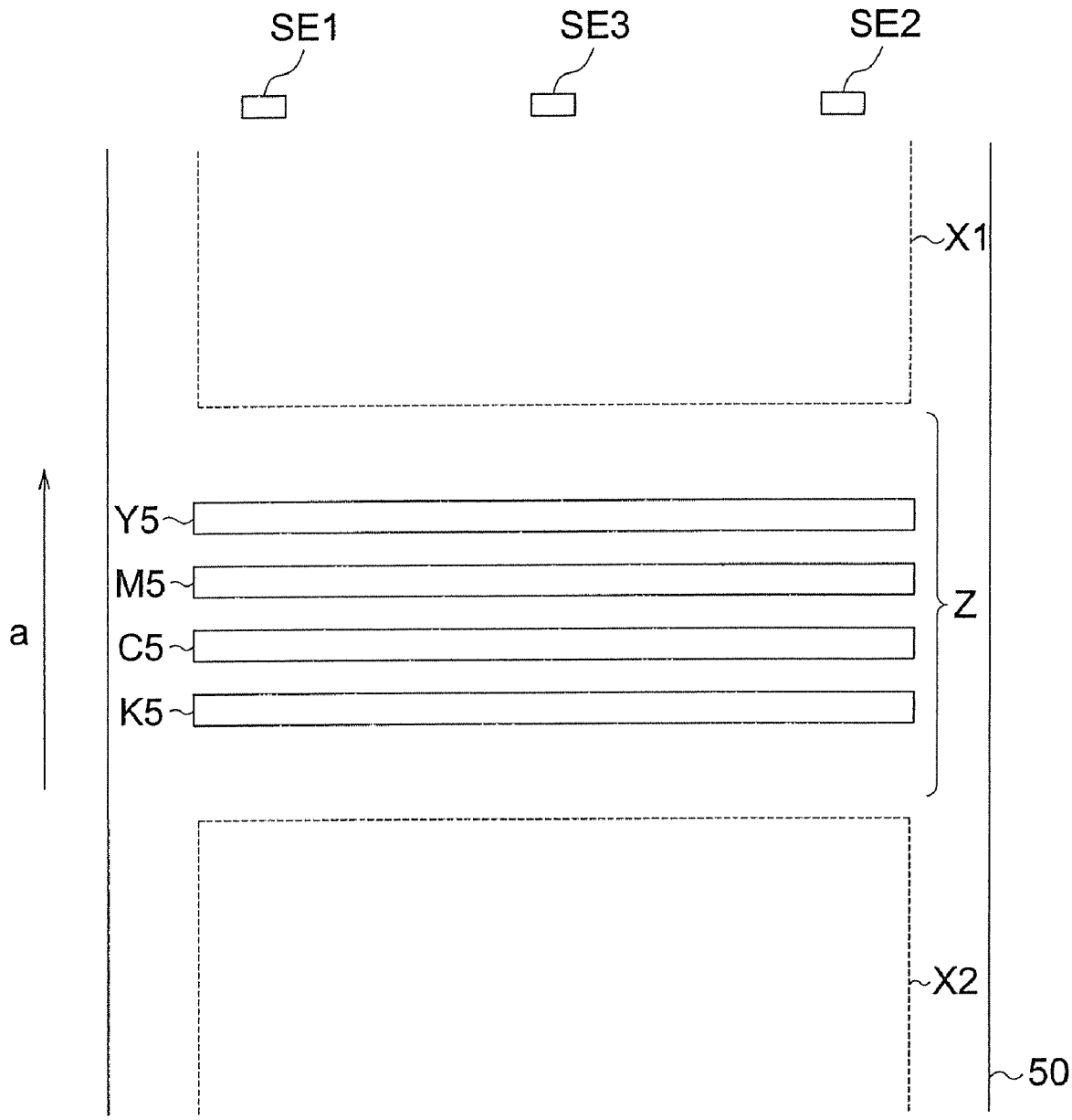
FIG. 9 is an explanatory diagram for forming the image pattern for forced discharge in the non-image area of the intermediate image transfer belt.

Next, the operation of forced toner discharge from the developing sections 440Y, etc. is explained here using FIG. 9.

While color images are being formed using the four image forming engines 40Y, 40M, 40C, and 40K in the image forming apparatus 1, when forming monochrome images, although the black toner in the image forming engine 40K gets exhausted, the other toners are not consumed but will remain accumulated in the developing sections 440Y, etc. The toners that are not consumed in such a case deteriorate, and in some cases this may affect the image quality. Further, when forming half tone color images, due to the difference in the toner quantities of different colors that were consumed during the previous image formation, there are cases in which it is not possible to form high quality half tone images.

Therefore, in order to solve such problems, in order to periodically discharge the toners of different colors from the developing sections 440Y, etc., as is shown in FIG. 9, band shaped toner images of different colors are formed on the intermediate image transfer belt 50. The image patterns Y5, M5, C5, and K5 for forced discharge are formed on the intermediate image transfer belt 50 in the non-image area Z between the image areas X1 and X2. Because the image patterns are formed in the non-image area Z, since it is not necessary to stop the print job that is being executed by the image forming apparatus 1, it is possible to prevent a reduction in the productivity.

Since the image patterns Y5, M5, C5, and K5 for forced discharge are formed for the purpose of discharging the toner from the developing sections 440Y, etc., the operation of detecting them using the optical sensors SE1, SE2, and SE3 is not executed. In other words, by merely forming the image patterns Y5, M5, C5, and K5 for forced discharge, it is possible to carry out image formation with high image quality.

[Timing of Executing Compensation Operations]

As has been explained above, in an image forming apparatus 1 according to the present preferred embodiment, four compensation operations (even toner forced discharge is treated as a compensation operation) are executed, and each compensation operation is executed at a prescribed time such as when the number of prints of the image forming apparatus 1 reaches a predetermined value, etc.

However, when the image forming apparatus 1 is operating for a long time, some times it is possible that the timing of execution of different compensation operations may coincide. In such a situation, if the image patterns used in the different compensation operations (for example the image patterns for position shift compensation shown in FIG. 4, or the image patterns for maximum density compensation shown in FIG. 7, etc.) are formed in different non-image areas, until the image patterns formed in the non-image area on the rear side along the direction of movement of the intermediate image transfer belt 50 are detected by the optical sensors SE1, etc., it is not possible to execute the compensation operation based on that image pattern. As a result, it is possible that the compensation operation is delayed and the image quality decreases. Therefore, the image patterns that do not overlap each other on the intermediate image transfer belt 50 are formed in the same non-image area, and the control is carried out so that multiple compensation operations are executed at the same time. In the following, this aspect is explained using FIG. 10 and FIG. 11.

Figure 10:
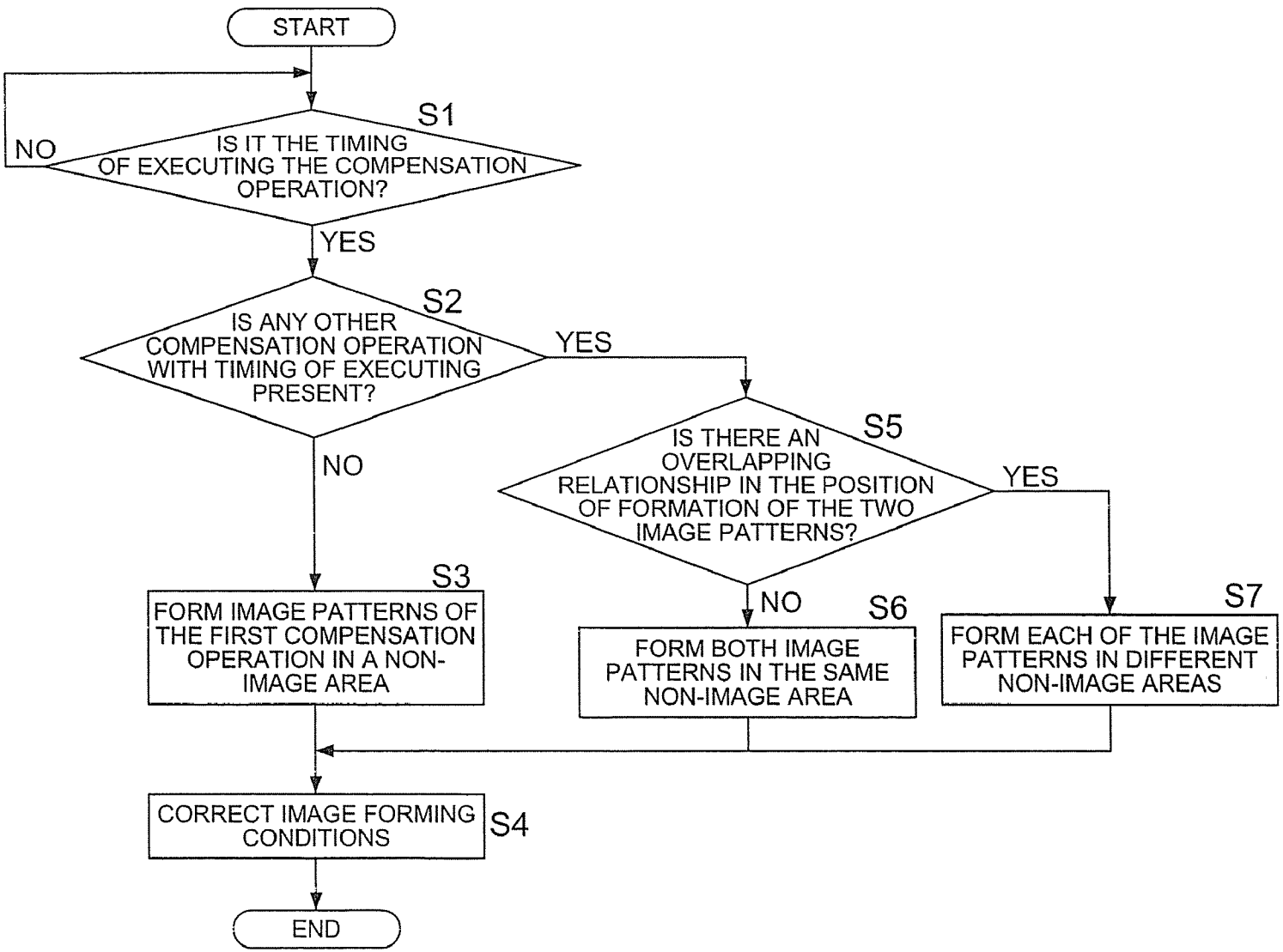
FIG. 10 is a flow chart showing the operation of adjusting the formation position of image patterns.

FIG. 10 is a flow chart showing the operation for adjusting the formation position of image patterns.

Firstly, a judgment is made as to whether or not it is time to execute a compensation operation (position shift compensation operation, or maximum density compensation operation, etc.,) (Step S1). The timing of executing a compensation operation is, when the number of prints of the image forming apparatus 1 has reached a predetermined value as was explained earlier, or when there is a specific operation by the user for executing the compensation operation, etc.

If it was judged in Step S1 that it is a time for executing a compensation operation (the compensation operation for which the execution timing has come in Step S1 is termed the "first compensation operation"), a judgment is made as to whether or not there are any other compensation operations whose timing of execution has come (Step S2). If there are no other compensation operations whose timing of execution has come in Step S2, the image patterns for the first compensation operation are formed in a non-image area (Step S3), those image patterns are detected if necessary by the optical sensors SE1, etc., and the image forming conditions are corrected (Step S4). For example, if the first compensation operation is a position shift compensation operation, the image patterns for position shift compensation Y1, Y2, M1, M2, C1, C2, K1, and K2 shown in FIG. 4 are formed on the intermediate image transfer belt 50, and the scanning positions of the photoreceptors for the different light exposure sections 430Y, 430M, 430C, and 430K are corrected.

On the other hand, if there is another compensation operation whose timing has come (the compensation operation for which the execution timing has come in Step S2 is termed the "second compensation operation"), a judgment is made as to whether or not the two image patterns (the image patterns for the first compensation operation and the image patterns for the second compensation operation) have an overlapping relationship such that the positions of their formation in the intermediate image transfer belt 50 coincide with each other (Step S5).

The fact that "both the image patterns have an overlapping relationship" is a relationship such that, when both the image patterns are formed in the non-image area, the image patterns overlap each other in the detecting area of the optical sensor along the width direction of the intermediate image transfer belt 50. The fact that "both the image patterns have a non-overlapping relationship" is a relationship such that, when both the two image patterns are formed in the non-image area, the image patterns do not overlap each other in the detecting area of the optical sensor along the width direction of the intermediate image transfer belt 50. In more specific terms, the image patterns for position shift compensation shown in FIG. 4 have a non-overlapping relationship with the image patterns for maximum density compensation shown in FIG. 7 or with the image patterns for gray scale compensation shown in FIG. 8. On the other hand, the image patterns for maximum density compensation shown in FIG. 7 have an overlapping relationship with the image patterns for gray scale compensation shown in FIG. 8. Further, the image patterns for forced discharge shown in FIG. 9 have an overlapping relationship will the image patterns for all the other compensation operations. These relationships are stipulated in a data table, and this data table is stored in the ROM 102. The operation of Step S5 is carried out by referring to the data table stored in the ROM 102, and is executed by the CPU 101, etc., based on some prescribed programs.

Figure 11:
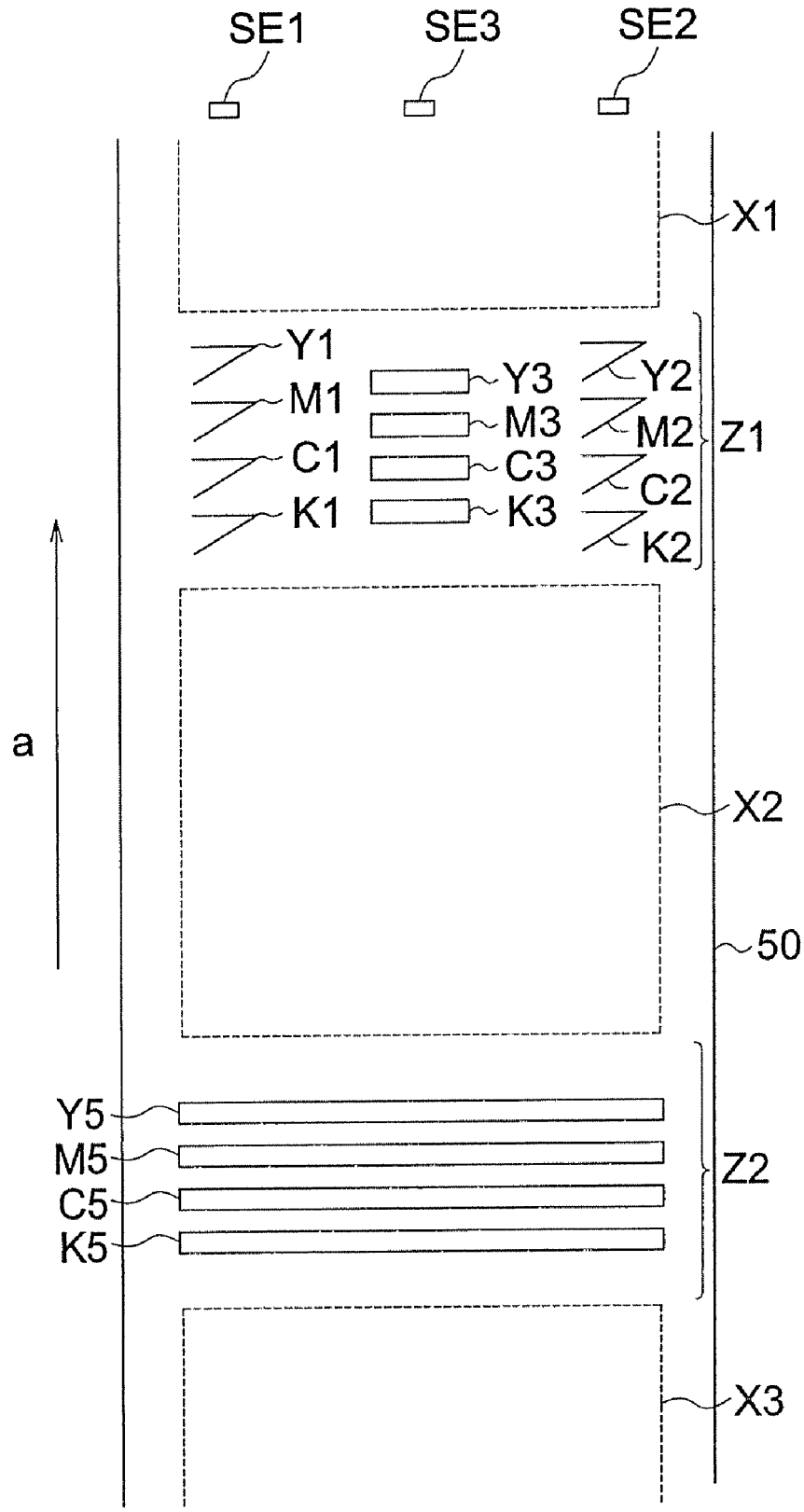
FIG. 11 is an explanatory diagram for forming several image patterns in the same non-image area.

If in Step S5 it is judged that the two image patterns have a relationship such that the positions of their formation on the intermediate image transfer belt 50 do not overlap each other (NO in Step S5), both the patterns are formed in the same non-image area (Step S6). For example, if the first compensation operation is a position shift compensation operation and the second compensation operation is a maximum density compensation operation, since the respective image patterns for compensation operation have a non-overlapping relationship, both the image patterns are formed in the same non-image area Z1 as is shown in FIG. 11. These image patterns are detected by the optical sensors SE1, SE2, and SE3, and image forming conditions are corrected for position shift and maximum density (Step S4).

Figure 12:
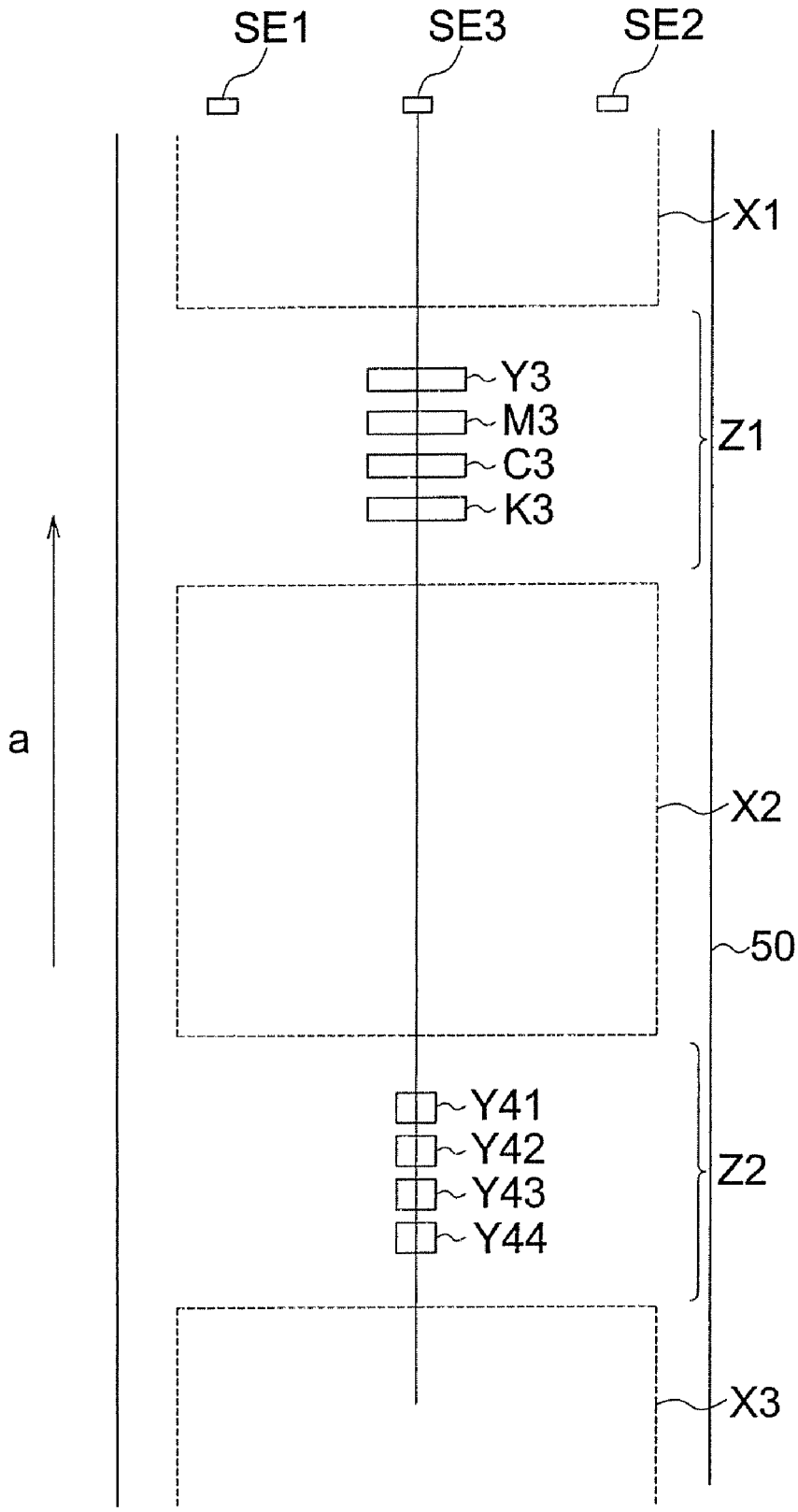
FIG. 12 is an explanatory diagram for forming several image patterns in different non-image areas.

On the other hand, if in Step S5 it is judged that the two image patterns have a relationship such that the positions of their formation on the intermediate image transfer belt 50 overlap each other (YES in Step S5), the two patterns are formed in different non-image areas (Step S7). For example, if the first compensation operation is a maximum density compensation operation and the second compensation operation is a gray scale compensation operation, since the respective image patterns for compensation operation have an overlapping relationship, as is shown in FIG. 12, the image patterns for maximum density compensation are formed in the non-image area Z1 and the image patterns for gray scale compensation operation are formed in the non-image area Z2. These image patterns are successively detected by the optical sensor SE2, and the image forming conditions are corrected for maximum density and gray scale (Step S5).

However, while it is necessary to form the image patterns for position shift compensation operation and the image patterns for maximum density compensation operation accurately in terms of shape and density, since the image patterns for forced discharge of toner are formed for the purpose of discharging the toner from the developing sections 440Y, etc., it is not necessary to form these accurately in terms of shape or density. In addition, since the operation of the polygon is unstable in the middle of carrying out phase control of the drive clock in the polygon of the light exposure section for the purpose of carrying out position shift compensation, it is not possible to carry out accurate image patterns. Considering this point, if the timing of execution in the non-image zone Z2 occurs while the image patterns for position shift formed in the non-image area Z1 are detected by the optical sensors SE1 and SE2 as shown in FIG. 11 and the phase control of the drive clock in the polygon is being executed, then the image patterns Y5, M5, C5, and K5 for forced discharge are formed. In this manner, if the image patterns are formed in the non-image area considering the characteristics of the image patterns, it is possible to carry out compensation of the image forming conditions efficiently.

As has been explained above, among the compensation operations whose timing of execution coincide, by forming in the same non-image area the image patterns of those compensation operations that do not have an overlapping relationship of the position of formation in the intermediate image transfer belt 50, it is not only possible to carry out the compensation operations for stabilizing the image quality without any delay, but it is also possible to prevent a decrease in the productivity. Particularly in the case of a tandem type image forming apparatus 1 that can form images at a high speed, it is effective to execute the operation shown in FIG. 10.

Further, the present invention shall not be construed to be restricted to its preferred embodiments, but any modifications or additions that do not deviate from the scope and intent of the present invention shall be included within the present invention. S7 in FIG. 10 describes that the image patterns are formed in different non-image areas, however each image pattern may be shifted in the longitudinal direction respondng to the size of each image pattern and/or the size of the none image area, thereby forming each image pattern in the same none image area, for example.

In the present preferred embodiment, although explanations were given for the position shift compensation operations and maximum density compensation operations, the present invention shall not be restricted to these compensation operations.

What is claimed is:

1. An image forming apparatus comprising:

an image carrier;

an image forming section which forms image patterns for a compensation operation on the image carrier;

a detection section which detects the image patterns formed on the image carrier; and a control section which controls at least the image forming section and the detection section, wherein the control section controls the image forming section and the detection section to form the image patterns at a non-image area between image areas on the image carrier, to detect the image patterns as required, and to execute various types of compensation operations for correcting the image forming conditions, and, when a timing of executing a first compensation operation coincides with a timing of executing a second compensation operation and the image pattern for the first compensation operation and the image pattern for the second compensation operation have a non-overlapping relationship at a position where the image patterns are to be formed on the image carrier, controls the image forming section to form both the image patterns in the same non-image area.

2. The image forming apparatus described in claim 1, wherein, when the timing of executing the first compensation operation coincides with the time of executing the second compensation operation and the image pattern for the first compensation operation and the image pattern for the second compensation operation have an overlapping relationship at the position where the image patterns are to be formed on the image carrier, the control section controls the image forming section to form each image pattern in different non-image areas.

3. The image forming apparatus described in claim 1, wherein the control section controls the image forming section by referring to a data table which stipulates a relation between the first compensation operation and the second compensation operation.

4. The image forming apparatus described in claim 1, wherein the first compensation operation or the second compensation operation is an operation which compensates an image position of each color.

5. The image forming apparatus described in claim 1, wherein the first compensation operation or the second compensation operation is an operation which compensates a maximum density of an image formed on the image carrier.

6. The image forming apparatus described in claim 1, wherein the first compensation operation or the second compensation operation is an operation which compensates a tone of an image formed on the image carrier.

7. The image forming apparatus described in claim 1, wherein the first compensation operation or the second compensation operation is an operation which forcibly discharges a toner from the image forming section.

8. The image forming apparatus described in claim 1, wherein the first compensation operation or the second compensation operation is executed when a number of prints of the image forming apparatus has reached a predetermined value.

9. The image forming apparatus described in claim 1, comprising a plurality of photoreceptors, wherein the image carrier is an intermediate transfer member in which images of different colors formed by the plurality of photoreceptors are superimposed on one another.

10. The image forming apparatus described in claim 1, wherein, when the timing of executing the first compensation operation coincides with the time of executing the second compensation operation and the image pattern for the first compensation operation and the image pattern for the second compensation operation have an overlapping relationship at the position where the image patterns are to be formed on the image carrier, the control section controls the image forming section to shift each image pattern in a longitudinal direction, thereby forming each image pattern in the same none image area.

11. The image forming apparatus described in claim 1, comprising a plurality of writing sections each of which writes images by scanning a light beam.

* * * * *